US005848810A

United States Patent [19]

Beaudoin et al.

[11] Patent Number: 5,848,810

[45] Date of Patent: Dec. 15, 1998

[54] PRINTED LABELS FOR POSTAL INDICIA

[75] Inventors: James S. Beaudoin, Little Saumico, Wis.; Edward E. Roske, Waukesan, Ill.

[73] Assignee: Moore Business Forms, Inc., Grand Island, N.Y.

[21] Appl. No.: 566,690

[22] Filed: Dec. 4, 1995

[51] Int. Cl.[6] ..... B42D 15/00

[52] U.S. Cl. ..... 283/67; 283/71; 283/116

[58] Field of Search ..... 283/71, 117, 67, 283/70, 116

[56] References Cited

U.S. PATENT DOCUMENTS

| | | | |
|---|---|---|---|
| 231,365 | 8/1880 | Small . | |
| 2,709,001 | 5/1955 | Stahl . | |
| 3,652,830 | 3/1972 | Kessler . | |
| 4,533,586 | 8/1985 | Roule et al. . | |
| 4,649,266 | 3/1987 | Eckert . | |
| 4,715,622 | 12/1987 | Mikhail . | |
| 4,725,077 | 2/1988 | Fujita . | |
| 5,075,862 | 12/1991 | Doebenl et al. | 283/71 |
| 5,098,130 | 3/1992 | Mikhail . | |
| 5,408,927 | 4/1995 | Gallagher et al. . | |
| 5,423,573 | 6/1995 | de Passille . | |

FOREIGN PATENT DOCUMENTS

| | | |
|---|---|---|
| 0137522 | 4/1985 | European Pat. Off. . |
| 2410324 | 7/1979 | France . |

*Primary Examiner*—Willmon Fridie, Jr.
*Attorney, Agent, or Firm*—Nixon & Vanderhye P.C.

[57] ABSTRACT

Pressure sensitive adhesive labels having postal indicia on them are used to produce mailing pieces, and allow production of distinctive mailing pieces at high speeds (e.g. 300–500 feet per minute). The labels have "POSTAGE PAID", an indication of rate such "BULK RATE" or "FIRST CLASS MAIL", and an indication of permit authorization such as "PERMIT NO.". The pressure sensitive adhesive of the label is adhered to an envelope or postcard at an upper right corner of an addressable face of the envelope or postcard. The label may have the same size as (and simulate) a conventional postage stamp, and the indicia may overlie the decorative graphics, with the indicia and the decorative graphics sharply color contrasting. The labels may simulate first class postage metering including a circle indicating the zip code of origin. The labels are typically either tipped on or blown on an envelope web, and a business reply envelope (also with a label having similar "POSTAGE PAID" indicia, etc.) may be inserted in an outgoing envelope (if a distinct envelope), or may be formed with the outgoing envelope (if a mailer type business form).

18 Claims, 3 Drawing Sheets

*Fig. 5*
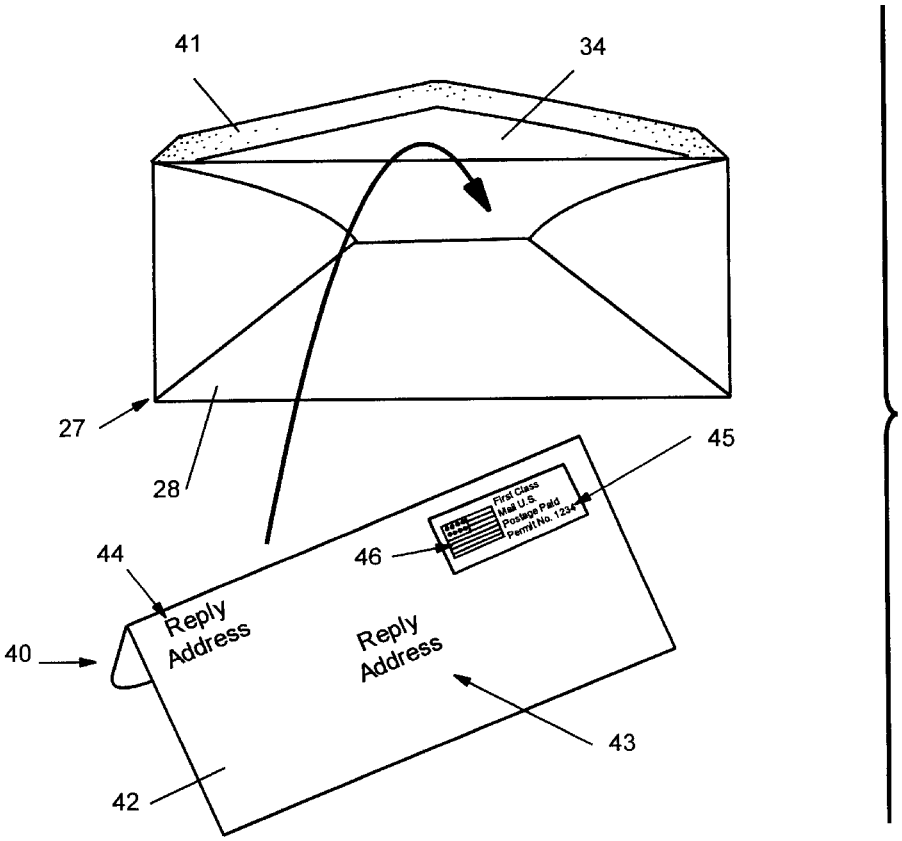
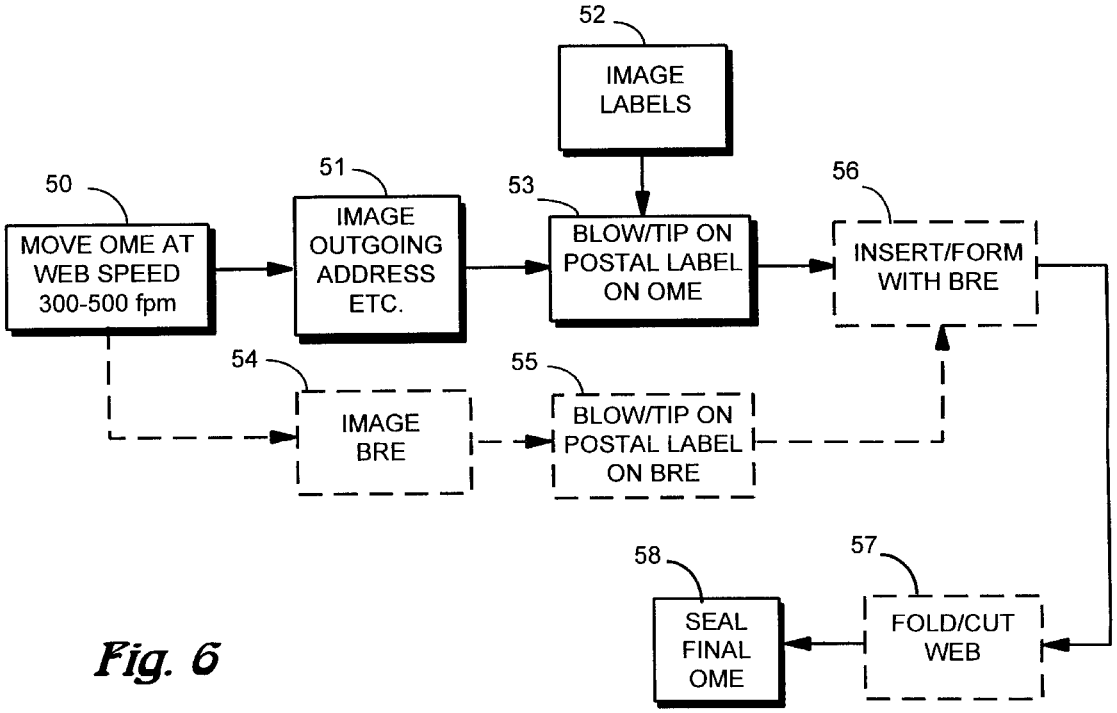
*Fig. 6*

PRINTED LABELS FOR POSTAL INDICIA

BACKGROUND AND SUMMARY OF THE INVENTION

It is well known in the production of mass mailings that machine printed postal indicia (postal franking) can indicate to the recipient that the enclosed material is "junk mail" thus resulting in the recipient simply discarding the mail piece thereby resulting in a possible loss of revenue by the postal customer, since the mail piece went unopened and the purchase or service opportunity was lost. It has been found that the placing of stamps on envelopes involved in a mass mailing campaign results in a greater acceptance by the recipient, as the mail does not appear to be a mass mailing product, but rather a product in which a stamp was physically applied to the outgoing envelope. However, it is expected that the recipient or target of such mailings will soon begin to recognize a particular stamp as being associated with mass mailing or advertising campaigns and as such, there is a need to enhance or be able to vary the image of the mail piece while at the same time, being sure to allow adequate tracking of the revenue streams for the Postal Service.

According to the present invention a label having postal indicia thereon, a mailing piece utilizing the labels, and a method of production of mailing pieces utilizing the labels, are provided which address the problem described above. The labels produced and utilized according to the present invention increase the acceptance of mass mailing pieces while enhancing the image of the mailing pieces, but still simultaneously continuing to maintain a means by which the Postal Service can track the revenue of mail, such as with conventional indicia. The labels according to the present invention include decorative graphics having one or more colors along with postal indicia immediately adjacent or overlying the decorative graphics. The postal indicia includes necessary terminology for mass mailing postage charging, but is devoid of numerical postage such as are provided on conventional stamps produced by the Post Office.

According to one aspect of the present invention a label per se is provided. The label comprises the following components: A substrate that is rectangular in shape and has first and second major faces, and is dimensioned so that it will fit in the upper right corner of a conventional business envelope. Permanent pressure sensitive adhesive on the label first face. And, postal indicia imaged on the label second face and including: "POSTAGE PAID", an indication of rate, and an indication of permit authorization; and the imaged second face including decorative graphics having one or more colors immediately adjacent or underlying the indicia.

The indicia on the label second face may include "BULK RATE" as an indication of rate, and the indicia on the label second face may also include as an indication of permit authorization "PERMIT NO.". The label may be approximately the same size as a conventional postage stamp with the indicia overlying the decorative graphics, the indicia being black or having a color, and the black or color of the indicia sharply contrasting with the decorative graphics color or colors that it overlies. The label may alternatively have indicia that simulates first class postage metering and includes "FIRST CLASS MAIL" as an indication of rate, and include "PERMIT NO." as an indication of permit authorization.

According to another aspect of the present invention a mailing piece is provided comprising the following components: An envelope or postcard having an addressable face with an upper right corner. And, a label having a first face with permanent pressure sensitive adhesive, and an imaged second face, the imaged second face including as indicia: "POSTAGE PAID", an indication of rate, and an indication of permit authorization; and the imaged second face including decorative graphics having one or more colors immediately adjacent or underlying the indicia. And, the label first face adhered to the envelope or postcard at the upper right corner thereof by the permanent adhesive.

The indication of rate indicia may include, as two common examples thereof, either "BULK RATE" or "FIRST CLASS MAIL", and the indication of permit authorization typically comprises "PERMIT NO.". The label may be as described above, in size and graphics and indicia color, and for example may be rectangular and have dimensions of about one inch by about ⅞ inch (or about 1⅜ inch by ⅞ inch, or about 1¾ inch by 1¼ inch). Alternatively the label may simulate first class postage metering, which may include a circle indicating the zip code of origin of the envelope or postcard.

Where the mailing piece is an envelope it may be either a standard separate envelope, or it may be a mailer type business form. In either case the final outgoing envelope has a left upper corner in a central right area, and typically has a return address in the left upper corner and an outgoing address in the central right area. A business reply envelope may be within (if the outgoing envelope is a separate envelope), or part of (if the outgoing envelope is a mailer type business form), the outgoing envelope, and the business reply envelope may also have a label such as described above affixed by permanent pressure sensitive adhesive in an upper right corner thereof. Typically the label on the business reply envelope (BRE) is one containing indicia indicating "FIRST CLASS MAIL" as the rate.

The invention also relates to a method of producing mailing pieces, the mailing pieces comprising envelopes or postcards having an addressable face with an upper right corner, using labels, the labels having a first face with permanent pressure sensitive adhesive, and an imaged second face which includes as indicia: "POSTAGE PAID", an indication of rate, and an indication of permit authorization; and decorative graphics immediately adjacent or underlying the indicia. The method preferably comprises the steps of automatically: (a) Moving the envelope or postcard in a predetermined path. (b) During the practice of step (a), imaging address information on the addressable face. And, (c) substantially immediately before or after step (b), while practicing step (a), tipping or blowing the label on the addressable face so that the label first face is adhered to the envelope or postcard upper right corner by the label permanent adhesive. Step (a) is typically practiced at a speed of between about 300–500 feet per minute (e.g. about 350 fpm), and where the mailing piece is an outgoing mailing envelope (OME) there may be the further step of (d) providing a business reply envelope with the outgoing envelope, the BRE preferably including a second label as described above. Step (d) may be practiced by providing a separate, distinct BRE and inserting the BRE in the OME, or by forming them as part of the same mailer. Step (c) may be practiced utilizing labels that are approximately the same size as conventional postal stamps, or simulating first class postage metering, as described above.

It is the primary object of the present invention to enhance the appearance, effectiveness, and overall desirability of mass mailings, and to do so in a manner that is cost effective and readily allows conventional cost recovery by the Postal Service (e.g. the USPS). This and other objects of the invention will become clear from an inspection of the detailed description of the invention and from the appended claims.

BRIEF DESCRIPTION OF THE DRAWINGS

FIG. 5 is a rear view of the envelope of FIG. 4 and shown in perspective view a business reply envelope that may be inserted therein; and FIG. 6 is a schematic block diagram illustrating various method steps that may be practiced according to the present invention.

DETAILED DESCRIPTION OF THE DRAWINGS

Figure 1:
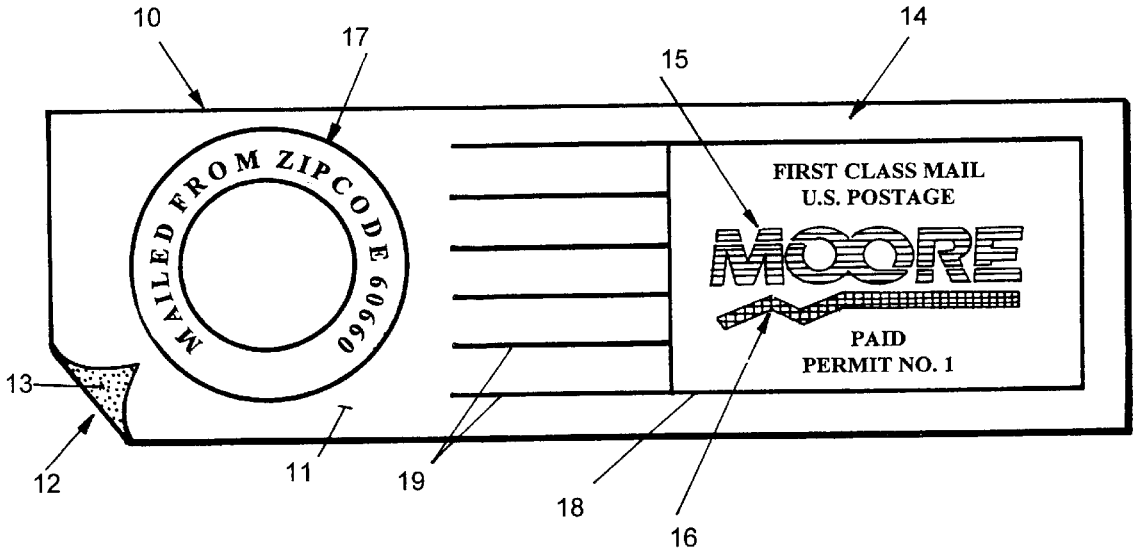
FIGS. 1 through 3 are top plan views of exemplary labels containing postal indicia according to the present invention.

FIG. 1 illustrates generally via reference numeral 10 an exemplary label with postal indicia according to the present invention. The label comprises a substrate 11 (typically of plastic) having a first major face—shown generally by reference numeral 12 (the back face as viewed in FIG. 1) with permanent pressure sensitive adhesive 13 thereon; and a second face 14 (the top face viewed in FIG. 1) with postal indicia imaged (e.g. applied by printing with a printing plate, or otherwise imaged utilizing any suitable conventional technique such as electrostatic printing, ink jet printing, or the like). Part of the postal indicia imaged on the face 14 is "POSTAGE PAID" as illustrated in FIG. 1 ("U.S. POSTAGE PAID"), as well as an indication of rate (the indicia "FIRST CLASS MAIL" in FIG. 1), and an indication of permit authorization [i.e. devoid of numerical postage such as "32¢"] ("PERMIT NO. 1" in FIG. 1). Also imaged on the second face 14 are decorative graphics illustrated schematically at 15 and 16 in FIG. 1. The decorative graphics 15, 16 have one or more colors (that is besides black and white) immediately adjacent the postal indicia such as "POSTAGE PAID", etc., in FIG. 1. In the illustrative embodiment illustrated in FIG. 1, the graphics 15 is illustrated as blue in color and is a commercial trademark or trade name in stylized form, while the symbolic graphics 16 is indicated as yellow in color and has a totally pictorial configuration (that is no words), e.g. simulating a lightening bolt.

In the FIG. 1 embodiment the postal indicia simulates first class postage metering, and to that end includes a circle 17 indicating the zipcode of origin of a mailing piece to which the label 10 would be applied, as well as other indicia/graphics simulating first class postage metering, such as the box 18 and lines 19. Of course the graphics 15, 16 are merely illustrative and any suitable graphics may be provided, such as trademarks, trade names, logos, pictorial representations, patriotic symbols, or the like.

Figure 2:
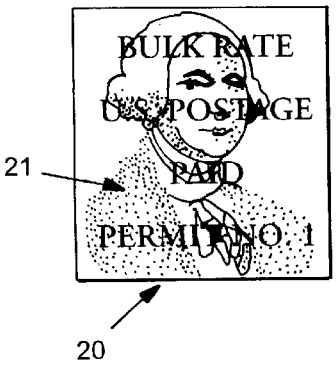
Figure 3:
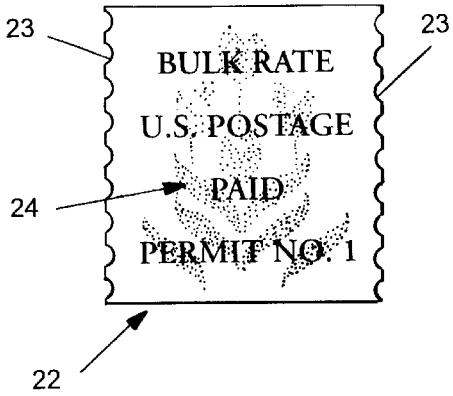

FIGS. 2 and 3 illustrate two other versions of exemplary labels according to the present invention. The label 20 of FIG. 2 includes as the graphics a color representation of George Washington (or another patriotic symbol such an eagle, flag, the Liberty Bell, or the like) 21, while the indicia such as "PERMIT NO. 1", "U.S. POSTAGE PAID", and "BULK RATE" (which is an indication of rate) are imaged so that they appear to overlie the graphics 21. The indicia may be black, or a color, and the indicia must sharply contrast in color with the color or colors of the graphics 21 which they appear to overlie. In this embodiment the label 20 has a size approximately the same as a conventional postage stamp, e.g. in this particular embodiment a rectangular shape and dimensions of about one inch by ⅞ inch, the most common stamp size. Of course any other conventional stamp size may be utilized, such as about 1⅜ inch by ⅞ inch, or about 1¾ by 1¼ inches, etc. Pressure sensitive adhesive—like the adhesive 13 from FIG. 1—is applied to the back face of the label 20.

The label 22 of FIG. 3 is the same as the label 20 except that the sides 23 thereof have a scalloped configuration, which simulates the sides of conventional postage stamps. The scalloped configuration 23 may be provided by actually scalloping the edges of the label 22 (as seen in FIG. 3), or by printing which simulates scalloping. In this particular embodiment the decorative colored graphics 24, which the postal indicia such as "BULK RATE" appears to overlie, simulates flowers. Of course almost any colored decorative graphics may be utilized as the graphics 24.

Figure 4:
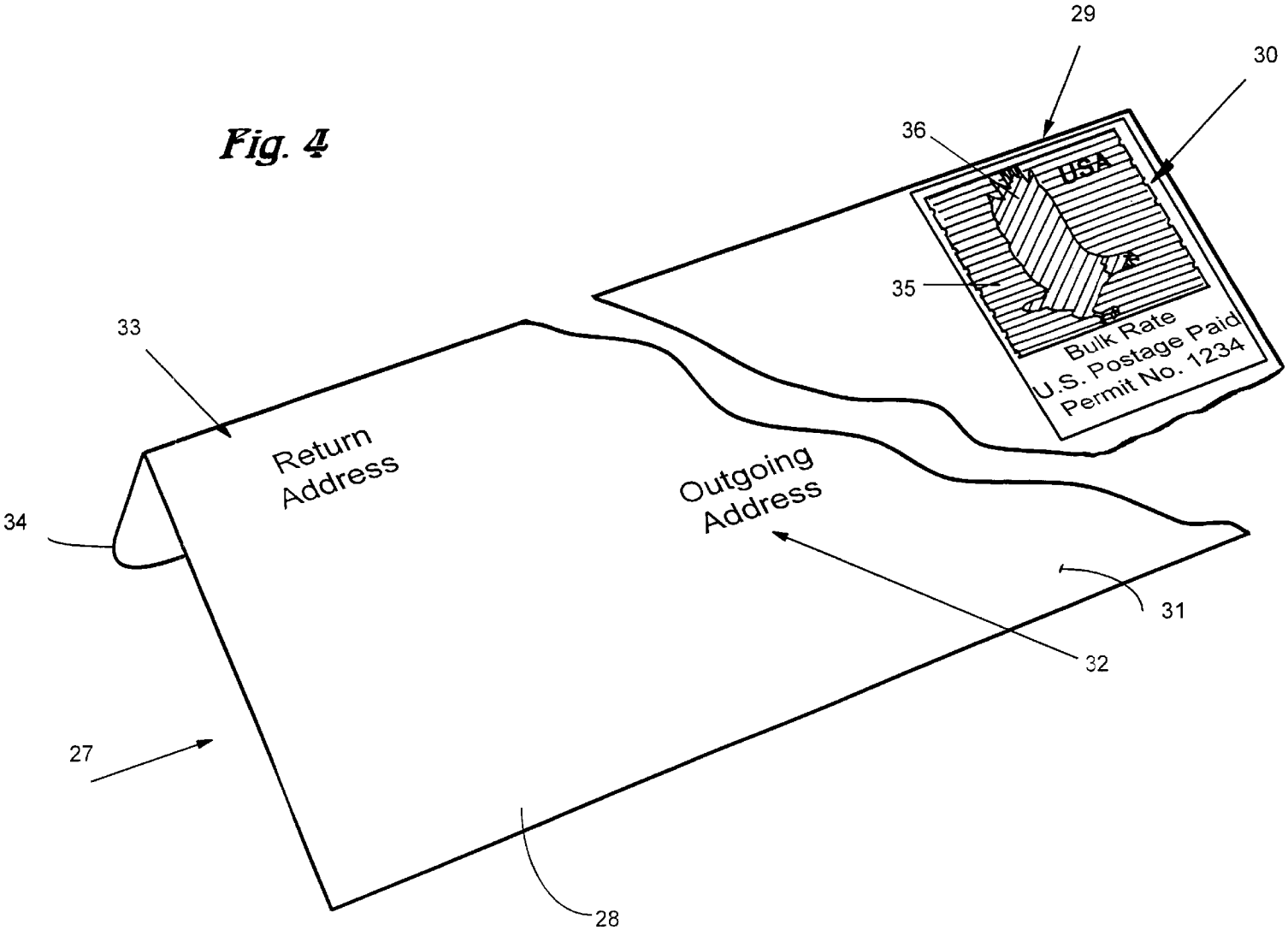
FIG. 4 is a top schematic view of an exemplary separate outgoing mailing envelope mailing piece having a label like that of FIGS. 1 through 3 adhered thereto.

FIG. 4 illustrates an exemplary mailing piece 27 according to the present invention, in this case in the form of a separate envelope 28 having an upper right corner 29 which is shown in larger size so as to more clearly illustrate the postal indicia label 30 utilized therewith according to the invention. The envelope 28 includes an addressable face 31, the primary face seen in FIG. 4, and typically includes outgoing address indicia 32 imaged thereon in a central right area thereof, as well as return address indicia 33 imaged in the upper left corner thereof. The envelope 28 flap 34 is for sealing the envelope 28 once it has been provided with suitable inserts. The envelope 28 is typically referred to as an "OME" and is typically of the standard business envelope size. It should also be understood that instead of a separate envelope 28 the mailing piece 27 according to the invention may comprise an envelope in the form of a conventional mailer type business form, or under some circumstances a postcard.

In the FIG. 4 embodiment the label 30 includes colored graphics in the form of a blue background and a brown eagle, shown generally by reference numerals 35 and 36 in FIG. 4, with the postal indicia (in this case "BULK RATE", "U.S. POSTAGE PAID", and "PERMIT NO. 1234") imaged on the label below the colored graphics 35, 36. The side edges of the colored graphics 35 simulate a stamp edge, such as illustrated by the reference numerals 23 in the FIG. 3 embodiment, in this case being printed on the substrate or the label. The label 30 is adhered to the upper right hand corner 29 of the envelope 28 by the conventional permanent pressure sensitive adhesive on the bottom face of the label 30 (not seen in FIG. 4).

A business reply envelope (BRE), such as shown by reference numeral 40 in FIG. 5, may be inserted into the envelope 28 as illustrated schematically in FIG. 5, and after insertion of the BRE 40 (as well as any other inserts desired) the flap 34 may be sealed by activating the rewettable adhesive 41, or like adhesive for sealing flap 34 to the body of the envelope 28. The BRE 40 in the embodiment illustrated in FIG. 5 also comprises a conventional envelope 42 (although of a size smaller than the envelope 28), having the desired reply address indicia 43 imaged in the central right portion thereof, typically the same address indicia—illustrated at 44—imaged in the upper left hand corner thereof, and preferably including a second label 45 according to the present invention. The second label 45 typically includes as the rate indication thereon "FIRST CLASS MAIL", and in this particular embodiment illustrates schematically an American flag 46 as the decorative colored graphics. The label 45 is adhesively secured to the upper right corner of the BRE 42 by permanent pressure sensitive adhesive.

The mailing pieces 27, 42 according to the present invention are much more effective than conventional mass mailings in getting a recipient's attention, and maximize the probability that the recipient will open up the piece 27. The pieces 27 may also be produced very quickly, being produced on-line during the variable imaging of the mailing pieces with the address information, etc., not requiring slow time-consuming and perhaps labor intensive procedures that would typically be necessary in the application of postal "stamps" to mailing pieces. FIG. 6 illustrates schematically exemplary method steps according to the method of the present invention, which all may be practiced on conventional equipment such as a Webtron Press, or the like. All the steps are performed automatically.

As illustrated schematically at 50 in FIG. 6, a web of mailing pieces, which may be separate envelopes on a substrate, a web of paper to be formed into separate envelopes, a web of paper to be formed into mailers, a carrier sheet containing postcards, a web of paper to be formed into postcards, or the like, is moved at a web speed that is high, such as about 300–500 feet per minute (e.g. about 350 fpm). While being moved at that speed, the OME (either already formed or in web form) is imaged with the outgoing address indicia, such as the indicia 32 illustrated in FIG. 4. This imaging is schematically represented in box 51 in FIG. 6, and may comprise any suitable conventional imaging technique such as electrostatic printing, impact printing, ink jet printing, etc. Labels, such as the labels 10, 20, 22, 30, 45, are separately imaged, as illustrated schematically at 52 in FIG. 6, and include the desired postal indicia according to the invention as well as decorative colored graphics. The labels imaged at 52 may either be conventional labels which have a release sheet carrier engaged by the pressure sensitive adhesive, or the labels may be linerless labels.

The labels from box 52 are applied to the OME "on press", as illustrated by box 53 in FIG. 6, utilizing conventional blow-on and tip-on techniques. Conventional blow-on and tip-on techniques may be practiced at the same desired speed of about 300–500 feet per minute, as the other procedures schematically illustrated in FIG. 6.

When BREs are to be utilized with the OMEs, the method steps indicated by boxes 54–56 in FIG. 6 are typically utilized. That is the BREs are imaged (the address information, such as the information 43) as illustrated in the box 54, the labels 45 are blown or tipped thereon as indicated at 55 in FIG. 6, and the BREs are inserted within or formed with the OMEs as illustrated by box 56 in FIG. 6. For example the BRE 40 may be inserted in the distinct envelope 28 as illustrated schematically at FIG. 5, or the BRE may be formed with a continuous web that is forming a mailer type business form. Where mailer type business forms are being formed, or envelopes are being formed from webs, there may also be the method step 57 illustrated in FIG. 6, where there was folding and/or cutting of the web. In any event the outgoing piece (when in envelope form whether a separate envelope or a mailer) is finally typically sealed as illustrated schematically at 58, producing a final mailing piece.

While the method steps are illustrated in a particular sequence in FIG. 6, the steps may be practiced in a wide variety of sequences, for example the label blow-on/tip-on illustrated schematically at 53 before or after the imaging step illustrated by block 51.

Practicing the invention it is thus possible to produce mailing pieces as an "on-line" operation for a Mailer, rather than as an "off-line" operation, with faster production times, reduced costs, minimal waste, no refund paper work and therefore cost savings, while at the same time producing distinctive high quality outgoing pieces. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent products and procedures.

What is claimed is:

1. A mailing piece comprising:

an outgoing envelope having an addressable face with an upper right corner, a left corner and a central right area; a return address in said left upper corner, and an outgoing address in said central right area; and a label having a first face with permanent pressure sensitive adhesive, and an imaged second face, said imaged second face including as indicia: "POSTAGE PAID", an indication of rate, and an indication of permit authorization; and said imaged second face including decorative graphics having one or more colors immediately adjacent or underlying said indicia;

said label first face adhered to said envelope or postcard at said upper right corner thereof by said permanent adhesive; and a business reply envelope within or part of said outgoing envelope, said business reply envelope having an upper right corner; and a second label having a first face with permanent pressure sensitive adhesive, and an imaged second face, said imaged second face including as indicia: "POSTAGE PAID", an indication of rate, and an indication of permit authorization; and said imaged second face including decorative graphics immediately adjacent or underlying said indicia; and said second label first face adhered to said business reply envelope at said upper right corner thereof by said second label permanent adhesive.

2. A mailing piece as recited in claim 1 wherein said indicia on said label second face includes as an indication of rate either "BULK RATE" or "FIRST CLASS MAIL".

3. A mailing piece as recited in claim 2 wherein said indicia on said label second face includes as an indication of permit authorization "PERMIT NO.".

4. A mailing piece as recited in claim 3 wherein said label is approximately the same size as a conventional postage stamp, and said indicia overlays said decorative graphics, and said indicia is black or has a color, and said black or color of said indicia contrasts with said decorative graphics color or colors that it overlies.

5. A mailing piece comprising:

an envelope or postcard having an addressable face with an upper right corner; and a label having a first face with permanent pressure sensitive adhesive, and an imaged second face, said imaged second face including as indicia: "POSTAGE PAID", as an indication of rate either "BULK RATE" or "FIRST CLASS MAIL", and as an indication of permit authorization "PERMIT NO."; and said imaged second face including decorative graphics having one or more colors immediately adjacent or underlying said indicia; and wherein said indicia overlays said decorative graphics, and said indicia is black or has a color, and said black or color of said indicia contrasts with said decorative graphics color or colors that it overlies;

said label first face adhered to said envelope or postcard at said upper right corner thereof by said permanent adhesive; and wherein said label is approximately the same size as a conventional postage stamp.

6. A mailing piece as recited in claim 1 wherein said label simulates first class postage metering.

7. A mailing piece as recited in claim 6 wherein said first class postage metering simulated by said label includes a circle indicating the zip code of origin of said envelope or postcard.

8. A method of producing mailing pieces, the mailing pieces comprising envelopes or postcards having an addressable face with an upper right corner, using labels, the labels having a first face with permanent pressure sensitive adhesive, and an imaged second face which includes as indicia: "POSTAGE PAID", an indication of rate, and an indication of permit authorization; and decorative graphics immediately adjacent or underlying the indicia; the method comprising the steps of automatically:

(a) moving the envelope or postcard in a predetermined path;

(b) while moving the envelope or postcard in the predetermined path imaging address information on the addressable face;

(c) substantially immediately before or after step (b), while moving the envelope or postcard in the predetermined path, tipping or blowing the label on the addressable face so that the label first face is adhered to the envelope or postcard upper right corner by the label permanent adhesive; and wherein step (c) is practiced using labels that are each approximately the same size as a conventional postage stamp, and the indicia includes "BULK RATE" as the rate indicia and overlays the decorative graphics, and the indicia is black or has a color, and the black or color of the indicia contrasts with the decorative graphics color or colors that it overlies.

9. A method as recited in claim 8 wherein step (a) is practiced at a speed of between about 300–500 fpm.

10. A method as recited in claim 9 wherein the mailing piece is an outgoing envelope, and comprising the further step of (d) providing a business reply envelope with the outgoing envelope.

11. A method of producing mailing pieces, the mailing pieces comprising outgoing envelopes having an addressable face with an upper right corner, using labels, the labels having a first face with permanent pressure sensitive adhesive, and an imaged second face which includes as indicia: "POSTAGE PAID", an indication of rate, and an indication of permit authorization; and decorative graphics immediately adjacent or underlying the indicia; the method comprising the steps of automatically:

(a) moving the outgoing envelope in a predetermined path;

(b) while moving the outgoing envelope in the predetermined path imaging address information on the addressable face;

(c) substantially immediately before or after step (b), while moving the envelope or postcard in the predetermined path, tipping or blowing the label on the addressable face so that the label first face is adhered to the outgoing envelope upper right corner by the label permanent adhesive;

(d) providing a business reply envelope with the outgoing envelope; and utilizing second labels, the second labels having a first face with permanent pressure sensitive adhesive, and an imaged second face which includes as indicia: "POSTAGE PAID", an indication of rate, and an indication of permit authorization; and decorative graphics immediately adjacent or underlying the indicia; and (e) tipping or blowing a second label on each business reply envelope.

12. A method as recited in claim 10 wherein step (d) is practiced by providing a distinct, separate, business reply envelope, and inserting the business reply envelope in the outgoing envelope.

13. A method as recited in claim 11 wherein step (c) is practiced using labels that are each approximately the same size as a conventional postage stamp, and the indicia includes "BULK RATE" as the rate indicia and overlays the decorative graphics, and the indicia is black or has a color, and the black or color of the indicia contrasts with the decorative graphics color or colors that it overlies.

14. A method as recited in claim 11 wherein step (c) is practiced using labels that simulate first class postage metering and include "FIRST CLASS MAIL" as rate indicia thereon.

15. A method as recited in claim 14 wherein step (c) is practiced using labels that include as part of the first class postage metering simulation a circle indicating the zip code of origin of the envelope or postcard.

16. A mailing piece as recited in claim 14 wherein said label is rectangular and has dimensions of about one inch by about ⅞ inch, or about 1⅜ inch by about ⅞ inch, or about 1¾ inch by about 1¼ inch.

17. A method as recited in claim 11 wherein step (a) is practiced at a speed of between about 300–500 fpm.

18. A method as recited in claim 11 wherein step (d) is practiced by providing a distinct, seperate, business reply envelope, and inserting the business reply envelope in the outgoing envelope.

* * * * *